US009126718B2

(12) United States Patent
Lewis

(10) Patent No.: US 9,126,718 B2
(45) Date of Patent: Sep. 8, 2015

(54) BOX FOR PACKAGING

(76) Inventor: Gavin John Lewis, Milton (AU)

( * ) Notice: Subject to any disclaimer, the term of this patent is extended or adjusted under 35 U.S.C. 154(b) by 0 days.

(21) Appl. No.: 14/006,356

(22) PCT Filed: Mar. 22, 2012

(86) PCT No.: PCT/AU2012/000306
§ 371 (c)(1),
(2), (4) Date: Sep. 20, 2013

(87) PCT Pub. No.: WO2012/126064
PCT Pub. Date: Sep. 27, 2012

(65) Prior Publication Data

US 2014/0008424 A1 Jan. 9, 2014

(30) Foreign Application Priority Data

Mar. 23, 2011 (AU) ..... 2011901077

(51) Int. Cl.

| | |
|---|---|
| ***B65D 5/468*** | (2006.01) |
| ***B65D 77/30*** | (2006.01) |
| ***B65D 5/66*** | (2006.01) |
| ***B65D 5/02*** | (2006.01) |
| ***B65D 5/54*** | (2006.01) |

(52) U.S. Cl.
CPC ..... *B65D 5/6611* (2013.01); *B65D 5/0236* (2013.01); *B65D 5/4608* (2013.01); *B65D 5/542* (2013.01); *B65D 77/30* (2013.01)

(58) Field of Classification Search
CPC .... B65D 5/0236; B65D 5/4608; B65D 77/30; B65D 5/542; B65D 5/6611
USPC ..... 229/117.16, 123.1, 123.2, 125.39, 206
See application file for complete search history.

(56) References Cited

U.S. PATENT DOCUMENTS

| | | | | |
|---|---|---|---|---|
| 3,529,764 | A * | 9/1970 | Reeves et al. | 229/125.39 |
| 3,567,108 | A * | 3/1971 | Corridon | 229/123.1 |
| 5,203,733 | A | 4/1993 | Patch et al. | |
| 6,047,882 | A * | 4/2000 | Sin et al. | 229/125.39 |
| 6,912,798 | B2 * | 7/2005 | Blau et al. | 428/194 |
| 2007/0063008 | A1 | 3/2007 | El-Afandi | |

FOREIGN PATENT DOCUMENTS

| | | | |
|---|---|---|---|
| EP | 0780311 | A1 | 6/1997 |
| GB | 2194935 | A | 3/1988 |
| GB | 2342914 | B | 9/2002 |
| GB | 2388837 | A | 11/2003 |
| JP | H03-1188 | | 1/1991 |
| JP | 5-162742 | A * | 6/1993 |

(Continued)

OTHER PUBLICATIONS

Written Opinion for PCT/AU2012/000306 dated May 18, 2012 (five pages).
International Preliminary Report on Patentability for PCT/AU2012/000306 dated May 23, 2013 (seventeen pages).
International Search Report by the Australian Patent Office for PCT/AU2012/000306 (three pages).

(Continued)

*Primary Examiner* — Gary Elkins
(74) *Attorney, Agent, or Firm* — Brown Rudnick LLP

(57) ABSTRACT

A box for packaging, the box including an aperture for packing or unpacking the box and one or more securing panels adapted to operatively secure the aperture closed using adhesive tape. The box also includes a wall panel, wherein a flap of the wall panel is configured to hingeably open to thereby assist in removing the adhesive tape from the one or more securing panels.

15 Claims, 11 Drawing Sheets

(56) References Cited

FOREIGN PATENT DOCUMENTS

| | | |
|---|---|---|
| JP | H06-6229 | 1/1994 |
| JP | 2003-072748 A | 3/2003 |

OTHER PUBLICATIONS

Extended European Search Report for Application No. 12761352.9 dated Aug. 13, 2014, (6 pages).

* cited by examiner

BOX FOR PACKAGING

CROSS-REFERENCE

This is a national stage of International Application Number PCT/AU2012/000306, filed Mar. 22, 2012, which was published as International Publication Number WO 2012/126064 A1 on Sep. 27, 2012, and which claims priority to and the benefit of Australian Patent Application Number 2011901077, filed Mar. 23, 2011, both of which are incorporated by reference herein in their entireties.

FIELD OF THE INVENTION

The present invention relates to a box for packaging and to methods of removing adhesive tape from the box.

BACKGROUND OF THE INVENTION

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Boxes for packaging typically include an aperture for inserting and removing goods, and one or more panels that may be secured over the aperture using adhesive tape. When removing goods from such boxes, the adhesive tape is usually cut using a knife to allow the panels to be opened, thereby providing access to the box. This results in delays due to time wasted in searching for a knife, risk of injury due to accidental cuts from using the knife, and potential damage to the packaged goods if the knife is inserted too deeply into the adhesive tape. Attempts at opening the box without a knife can be frustrating, time consuming and is often not possible. Furthermore, if the box is to be recycled the adhesive tape must first be removed, adding further operating costs to the recycling process.

Japanese Application No. 08083310 describes a box with an easily breakable auxiliary flap surrounded by perforations. When adhesive tape is applied to the box, it is stuck to the auxiliary flap. Separation of the auxiliary flap from the box by use of the perforations results in the end of the adhesive tape being removed together with the auxiliary flap. The adhesive tape is then peeled off by pulling the auxiliary flap. However, removal of the adhesive tape results in a hole in the side of the box, which makes the box unsuitable for reuse.

U.S. application Ser. No. 11/233,502 describes a box with at least one perforated access panel in at least one end portion of a corrugated packaging box. The panel includes a punch-in section and a tear-away section. A length of tape is applied to seal the box, and an end of the tape resides at least partially over the tear-away section. By pushing in the punch-in section the tear-away section becomes accessible. If an individual pulls on the tear-away section, both the tear-away section and the tape are torn from the box. However, in removing the tape the punch-in section and tear-away section are also removed from the box. This leaves a hole in the side of the box, making it unsuitable for reuse.

Accordingly, there is a need to provide a box for packaging which allows removal of the adhesive tape used to seal the box, and which is suitable for reuse.

SUMMARY OF THE INVENTION

In a first broad form, the present invention seeks to provide a box for packaging, the box including:

(i) an aperture for packing or unpacking the box;

(ii) one or more securing panels adapted to operatively secure the aperture closed using adhesive tape; and (iii) a wall panel, wherein a flap of the wall panel is configured to hingeably open to thereby assist in removing the adhesive tape from the one or more securing panels.

Typically, the wall panel includes a perforated region that is configured to divide when hingeably opening the flap of the wall panel.

Typically, the perforated region is configured to divide along a curved, line.

Typically, the wall panel includes two flaps that are configured to hingeably open, wherein the two flaps share a perforated region that is configured to divide when opening the two flaps.

Typically, the two flaps are configured to hingeably open parallel to each other.

Typically, the wall panel includes three perforated regions that are configured to each divide when hingeably opening the two flaps, wherein two of the perforated regions are configured to divide along a curved line and one of the perforated regions is configured to divide along a substantially straight line.

Typically, the box includes two wall panels which each include at least one flap that is configured to hingeably open.

Typically, the box includes two apertures for packing or unpacking the box and at least two securing panels adapted to operatively secure each aperture closed using adhesive tape, and wherein at least one wall panel includes at least two flaps that are configured to hingeably open to thereby assist in removing the adhesive tape from the at least two securing panels.

Typically, the box includes two apertures for packing or unpacking the box and at least two securing panels adapted to operatively secure each aperture closed using adhesive tape, and wherein at least two wall panels each include at least one flap that is configured to hingeably open to thereby assist in removing the adhesive tape from the at least two securing panels.

Typically, the box further includes adhesive tape, wherein the adhesive tape is in contact with at least one securing panel to secure at least one aperture closed.

Typically, the adhesive tape traverses at least one of the flaps of the wall panel that is configured to hingeably open.

Typically, the box is formed from cellulosic material.

Typically, the box is formed from cardboard.

In a second broad form, the present invention seeks to provide a method of removing adhesive tape from a box according to the first broad form of the present invention, wherein the box includes adhesive tape which is in contact with at least one securing panel to secure at least one aperture closed, and wherein the adhesive tape at least partially traverses a flap of the wall panel that is configured to hingeably open, wherein the method includes:

(i) hingeably opening the flap of the wall panel, thereby at least partially separating the adhesive tape from the wall panel;

(ii) grasping the at least partially separated adhesive tape; and (iii) pulling the grasped adhesive tape, thereby removing the adhesive tape from the box.

BRIEF DESCRIPTION OF THE DRAWINGS

An example of the present invention will now be described with reference to the accompanying drawings, in which.

DETAILED DESCRIPTION OF THE PREFERRED EXAMPLES

Figure 1:
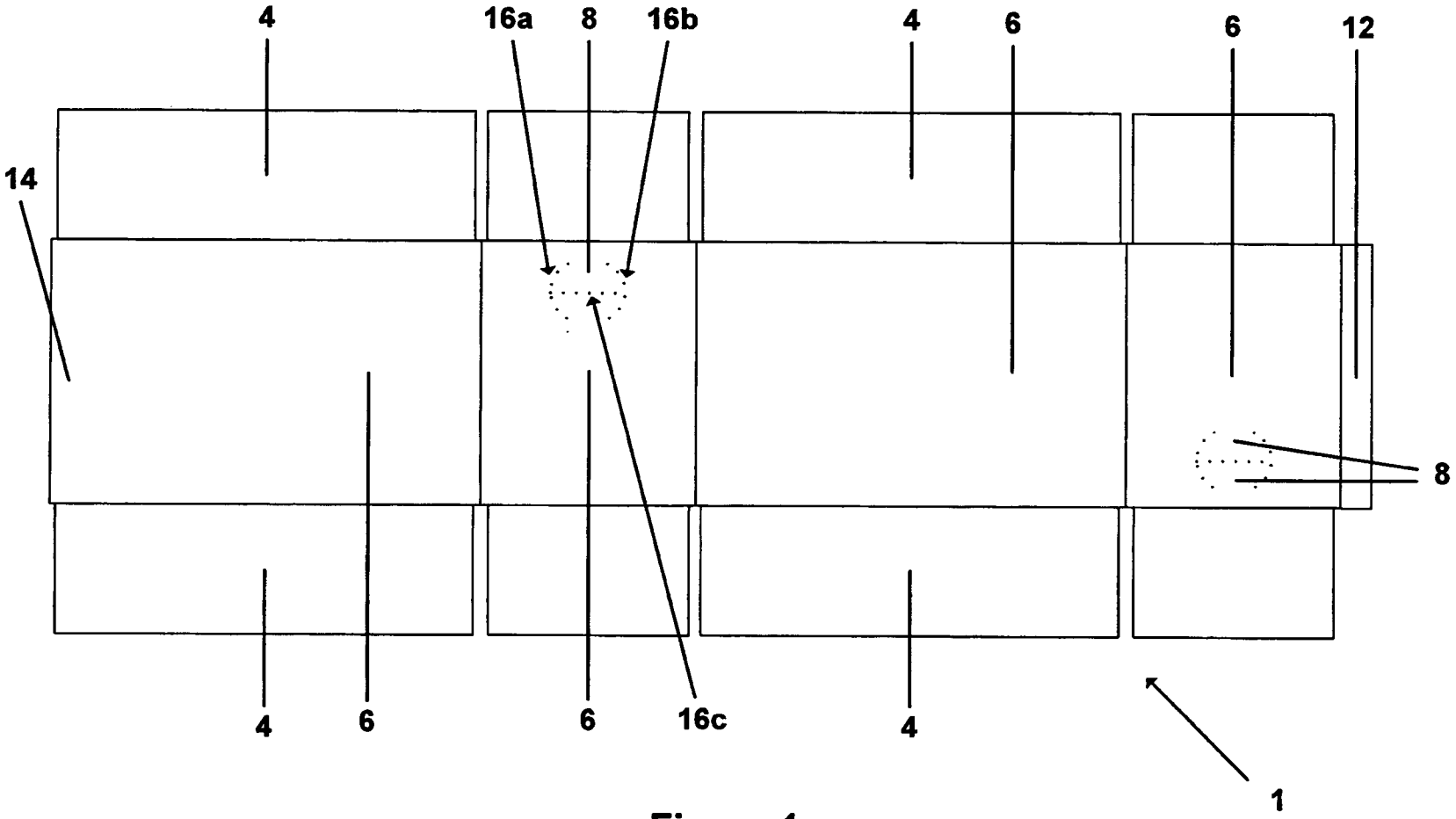
FIG. 1 is a plan view of a die cut of a first example box for packaging.

Examples of a box for packaging will now be described with reference to FIGS. 1 to 11.

The box (1) for packaging includes a number of wall panels arranged to provide an aperture (2) for packing or unpacking the box (1). One or more securing panels (4) are typically coupled to the wall panels to operatively secure the aperture (2) closed using adhesive tape (10). At least one of the wall panels (6) has a flap (8) that is configured to hingeably open to thereby assist in removing the adhesive tape (10) from the one or more securing panels (4).

When sealing the box (1), the one or more securing panels (4) are folded so that they close the aperture (2). Following this, adhesive tape (10) is applied so that the tape at least partially traverses the flap (8), and contacts the one or more securing panels (4) to secure the aperture (2) closed. When the user wishes to open the box (1), the flap (8) is hingeably opened, for example by applying a force to the flap (8) thereby pushing the flap (8) into the box (1), which at least partially separates the adhesive tape (10) at this location. This allows the adhesive tape (10) to be grasped by the user and then pulled, thereby removing the adhesive tape (10) from the flap and hence the box (1), whilst leaving the flap attached to the box (1). If after this initial use the user wishes to reuse the box (1), the flap (8) may be pushed back into alignment with the wall panel (6), so that the box (1) may be fully resealed and reused.

Further example features will now be described in further detail.

FIGS. 1 to 6 represent six example die cuts of a box (1) for packaging. Boxes may be assembled from the die cut by joining end panel (12) with the end of a wall panel (14), thereby forming a rectangle. For example, adhesives or staples may be used to join the end panel (12) with the end of the wall panel (14), although any other suitable joining method may be used.

The box (1) may be in a flattened form, as shown in FIGS. 1 to 6, or may be fully or partially assembled, as shown in FIG. 7 to 11.

The aperture (2) is an opening in the box (1), through which goods may be packed or unpacked. For example, when boxes are assembled from any of the six example die cuts shown in FIGS. 1 to 6, two apertures (2) are formed. The aperture (2) may be of any suitable shape, such as rectangular (as in FIGS. 1 to 7), square, circular, or oval. The example box (1) illustrated in FIG. 10 has a circular aperture that has been secured with two securing panels (4).

Figure 11:
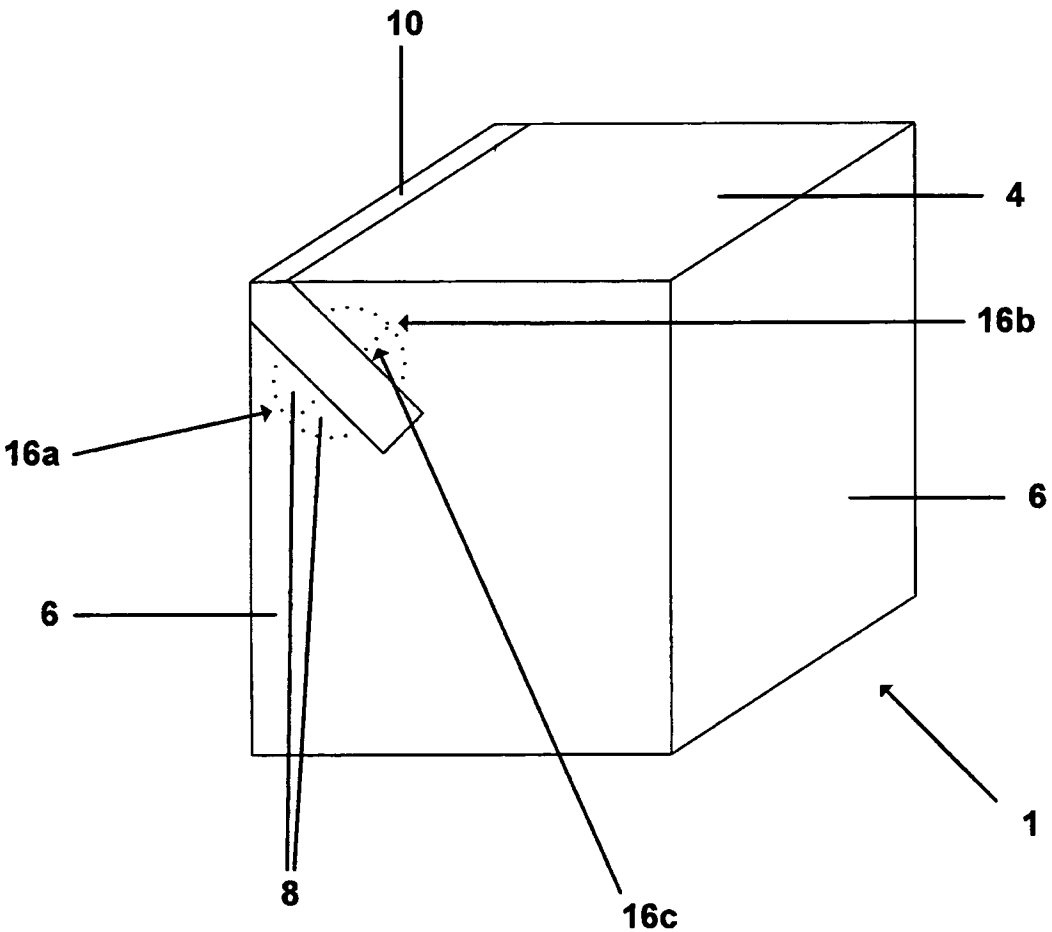
FIG. 11 is a perspective view of an eighth example box for packaging, to which adhesive tape is affixed to a single securing panel to secure the aperture closed.

The box (1) also includes one or more securing panels (4) adapted to operatively secure the aperture (2) closed using adhesive tape (10). The securing panels (4) are configured to close the aperture (2) when folded into position. Contacting the adhesive tape (10) with the securing panels (4) then secures the aperture (2) closed. The aperture (2) may be secured closed using only one securing panel (4), as illustrated in FIG. 11. Alternatively, two securing panels (4) may be used to secure the aperture (2) closed, as illustrated in FIGS. 1 to 10. More than two securing panels (4) may also be used.

The box (1) also includes one or more wall panels (6). The example illustrated in FIG. 10 includes a single cylindrical wall panel. On the other hand, four wall panels (6) are present in the examples illustrated in FIGS. 1 to 9 and 11. However, boxes of other shapes may have any number of wall panels (6).

At least one of the wall panels (6) includes a flap (8) which is configured to hingeably open. As used herein, the term "flap" applies to any hingeable portion, which is typically integrally formed as part of a wall panel (6). The term "hingeably open" applies to any arrangement in which the flap is able to fold or otherwise move out of alignment with the wall panel (6), for example through deformation of part of the wall panel (6). In one example, the flap (8) may hingeably open along a seam or fold in the wall panel (6).

Figure 5:
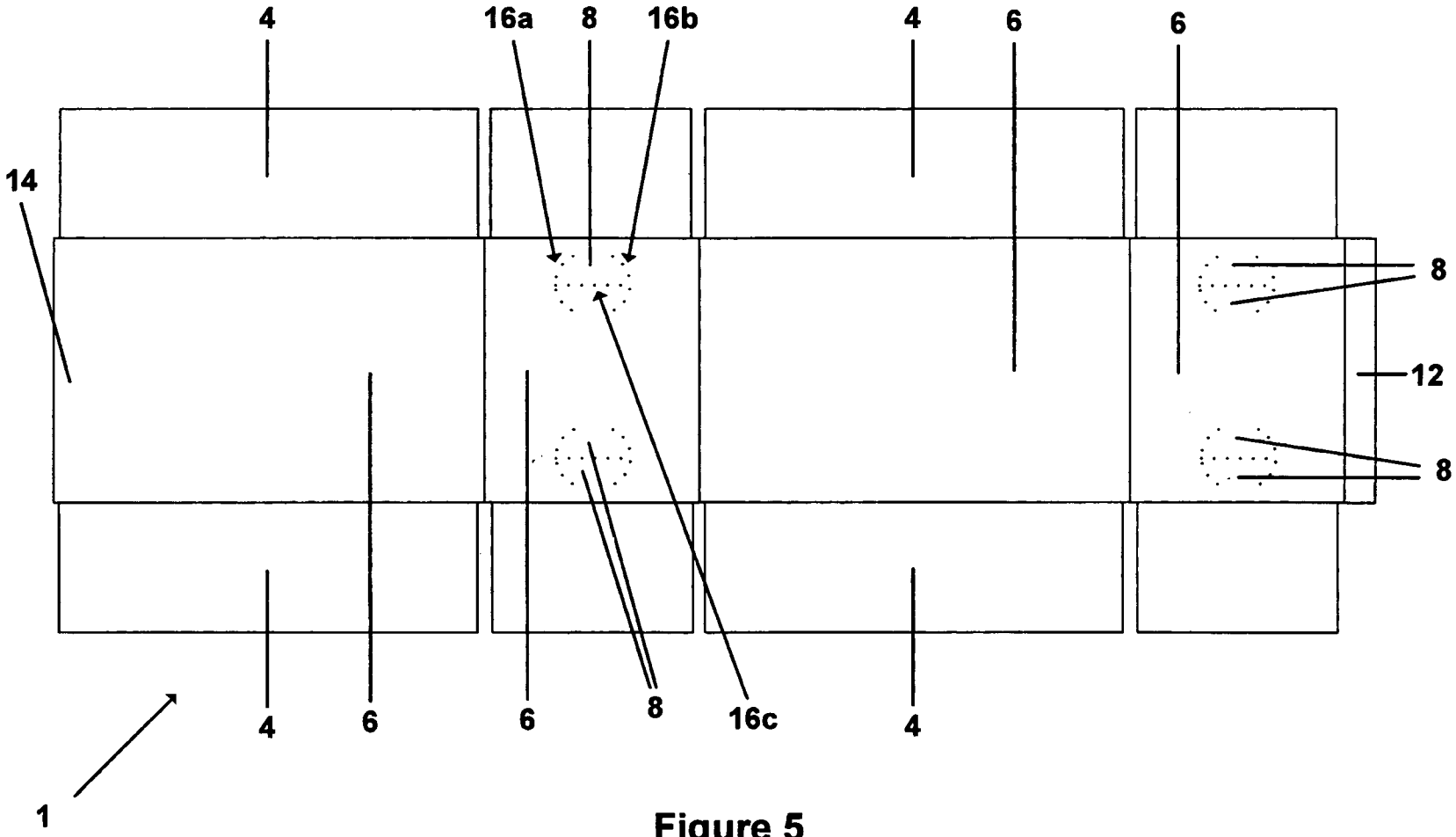
FIG. 5 is a plan view of a die cut of a fifth example box for packaging.
Figure 6:
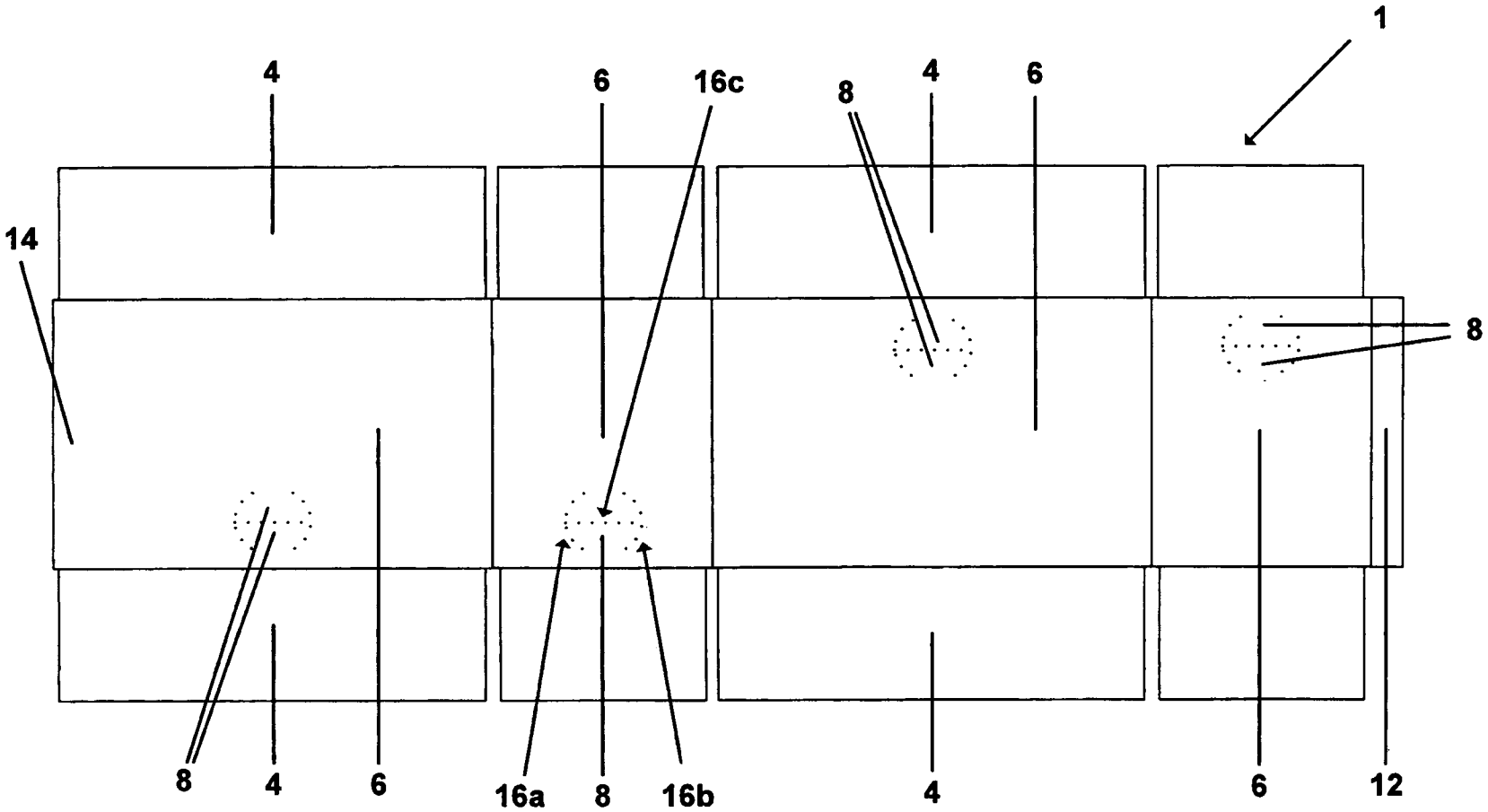
FIG. 6 is a plan view of a die cut of a sixth example box for packaging.
Figure 7:
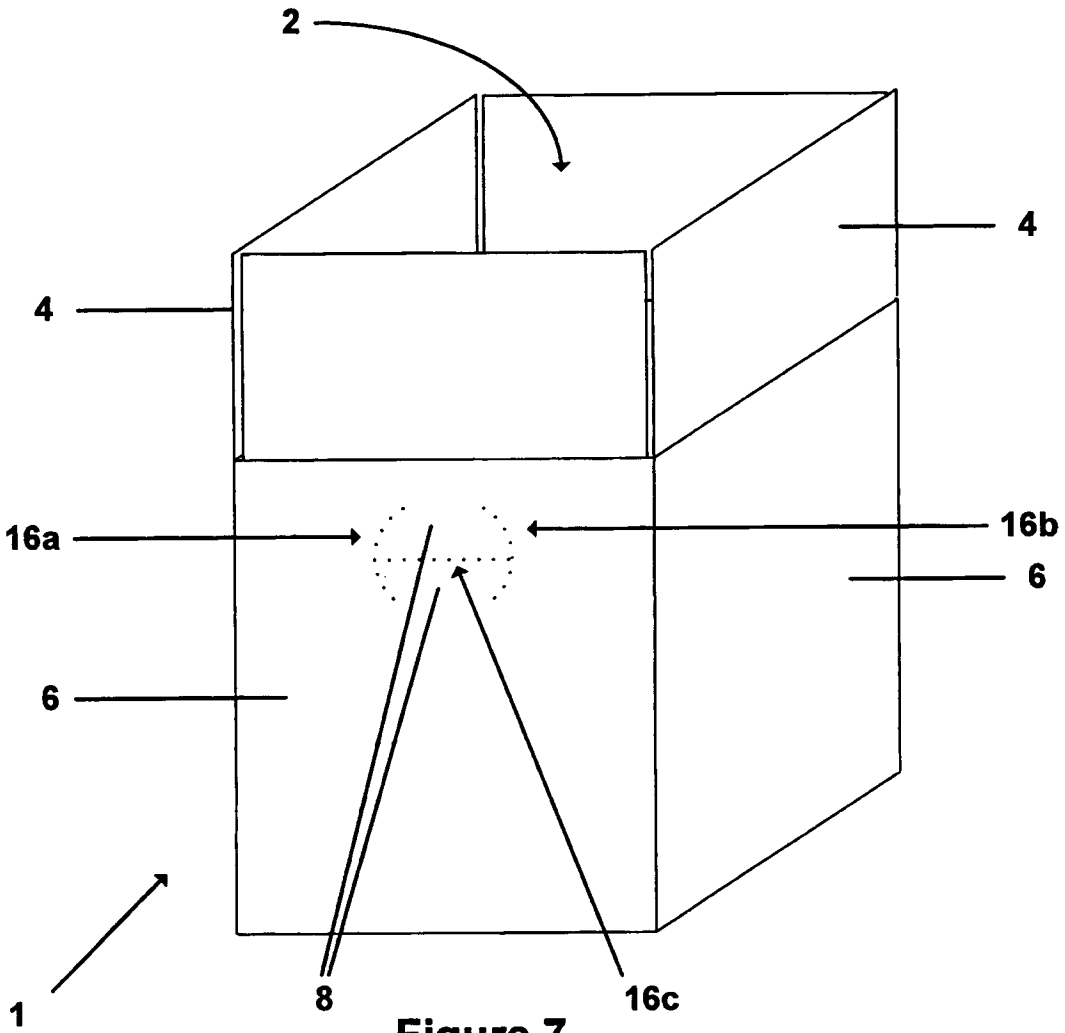
FIG. 7 is a perspective view of the first example box for packaging, when assembled.
Figure 8:
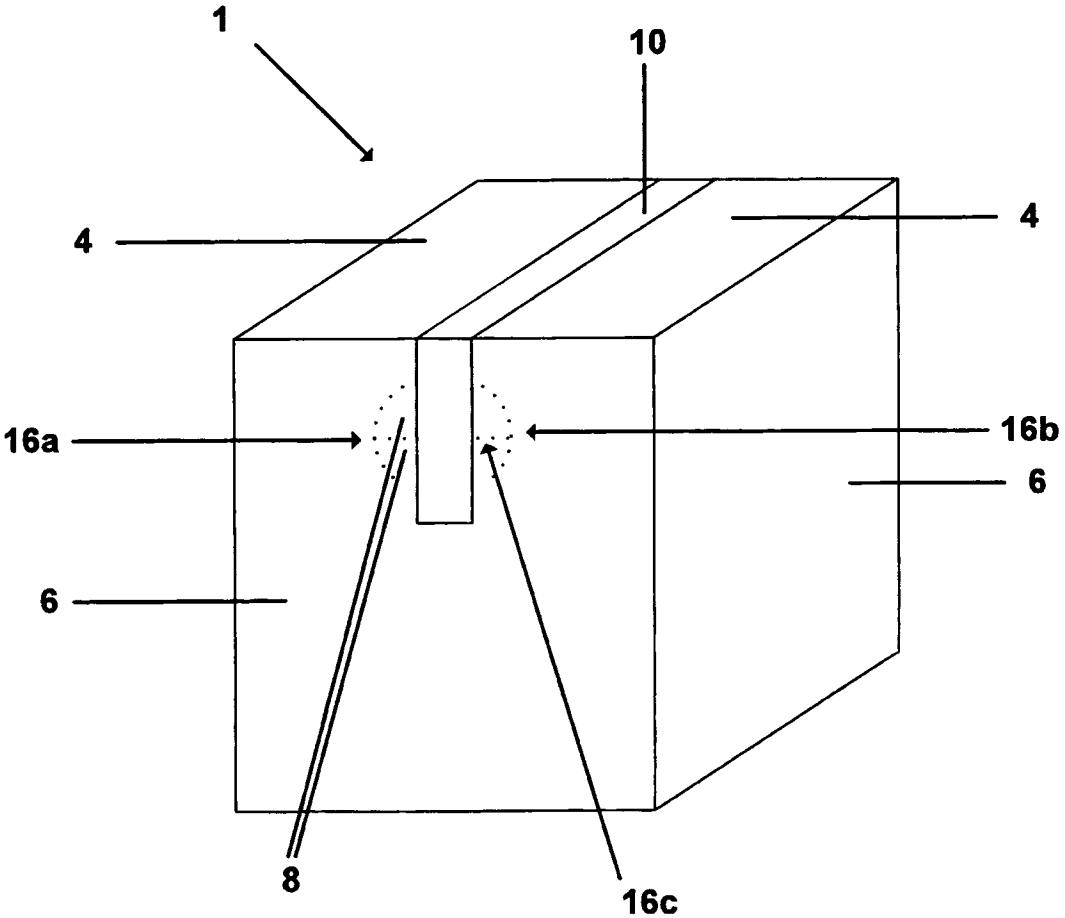
FIG. 8 is a perspective view of the first example box for packaging, when assembled and to which adhesive tape is affixed to the securing panels to secure the aperture closed.
Figure 9:
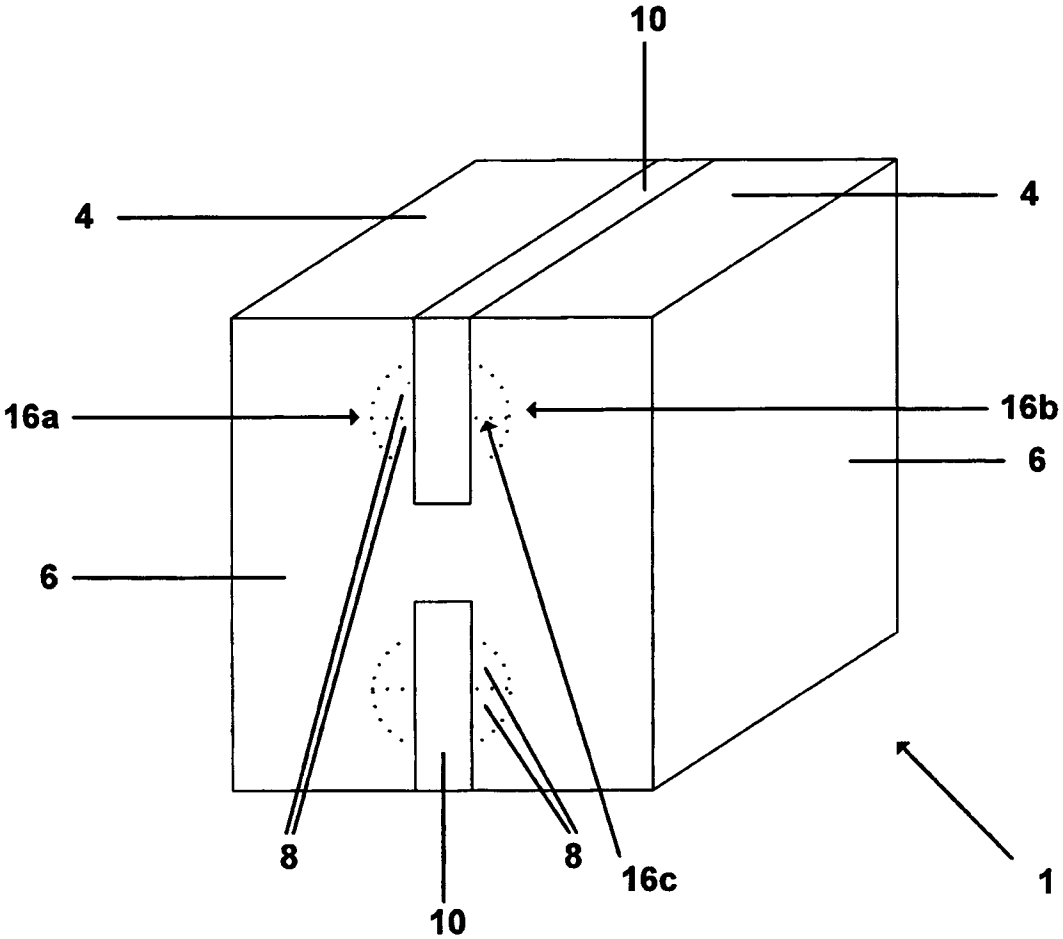
FIG. 9 is a perspective view of the fifth example box for packaging, when assembled and to which adhesive tape is affixed to the securing panels to secure the aperture closed.
Figure 10:
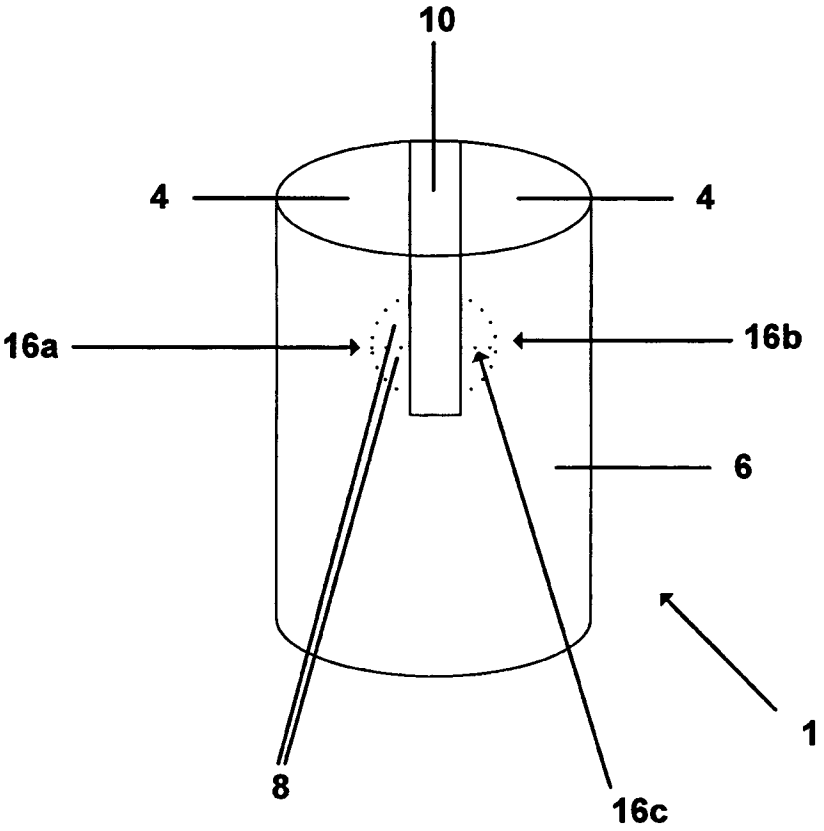
FIG. 10 is a perspective view of a seventh example box for packaging, to which adhesive tape is affixed to the securing panels to secure the aperture closed.

In various examples, the box (1) may include one wall panel (6) with at least one flap (8), two wall panels (6) with at least one flap (8), or three or four wall panels (6) with at least one flap (8). The examples illustrated in FIGS. 1 to 5 all include two wall panels (6) with at least one flap (8). However, and as illustrated in FIG. 6, all of the wall panels (6) may include at least one flap (8). In the example illustrated in FIG. 6, it is intended for a first length of adhesive tape (10) to be applied along the join formed between the securing panels (4) when they are folded to close the aperture (2), as well as a second length of adhesive tape (10) to be applied perpendicular to this join.

In a further example, the box (1) may be configured so that the adhesive tape (10) is not to be applied along a join formed between two or more securing panels (4) when they are folded to close the aperture (2). Instead the box (1) may be configured so that a length of adhesive tape (10) is to be applied, for example, perpendicular to the join.

In one example, the wall panel (6) includes a perforated region (16) that is configured to divide when hingeably opening the flap (8) of the wall panel (6). Dividing the perforated region (16) allows the flap (8) to be hingeably opened. However, in other examples at least some, or all of the boundaries of the flap (8) may be pre-cut. The term "perforated region" relates to a portion of the wall panel (6) which includes a number of perforations, especially in a line, which may be divided to thereby allow the flap (8) to open.

Figure 2:
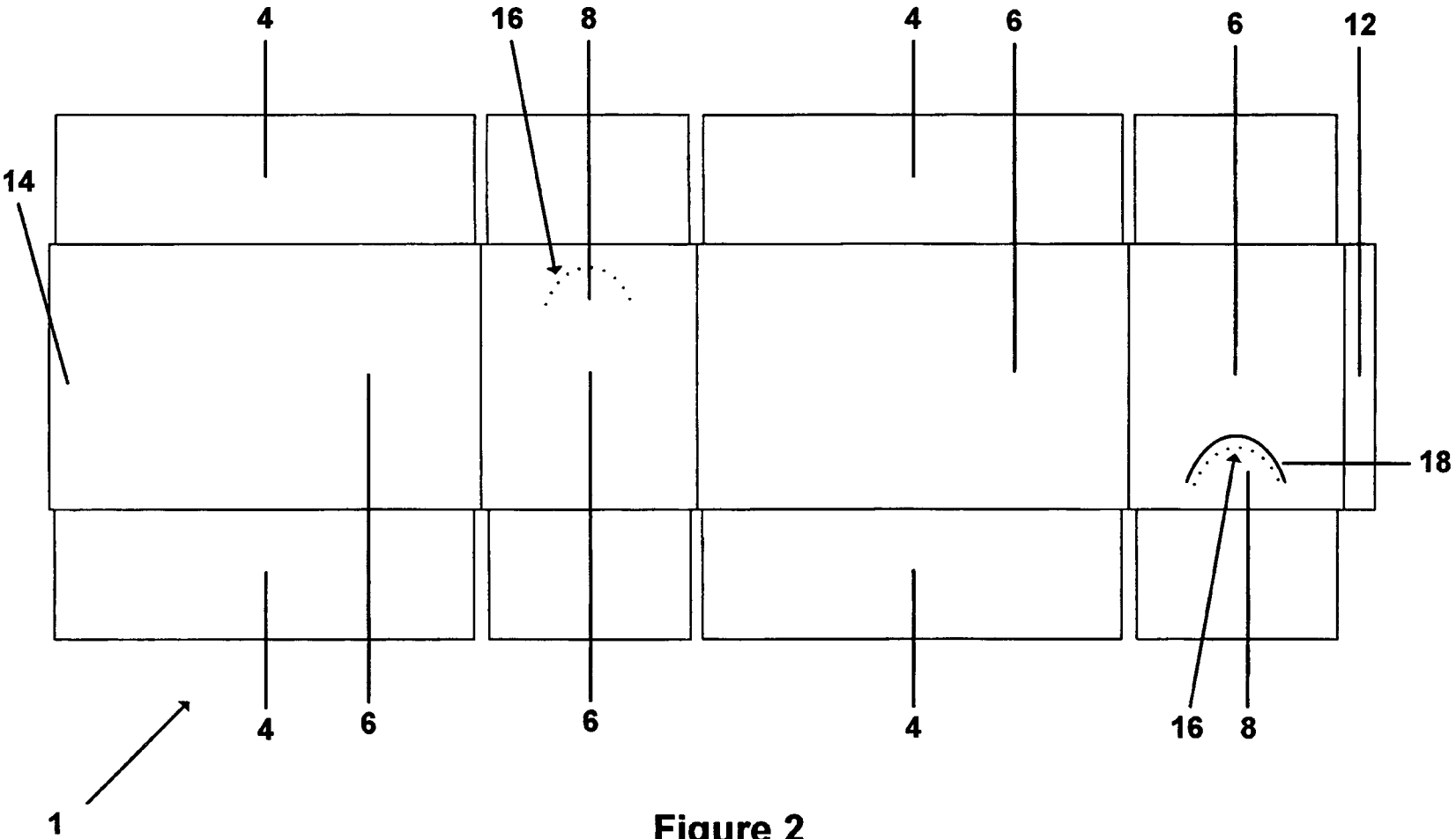
FIG. 2 is a plan view of a die cut of a second example box for packaging.

The perforated region (16) may be configured to divide in various configurations, and some of these are illustrated in the Figures. For example, the perforated region (16) may be configured to divide along a curved line, as illustrated in FIG. 2. Advantageously, if the perforated region (16) divides along a curved line it is believed that this minimises any compromise to the structural integrity of the box (1) when the flap (8) is hingeably opened, as the curved shape limits bending and folding under sideways pressure, which could potentially crush the box (1) and its contents.

Figure 3:
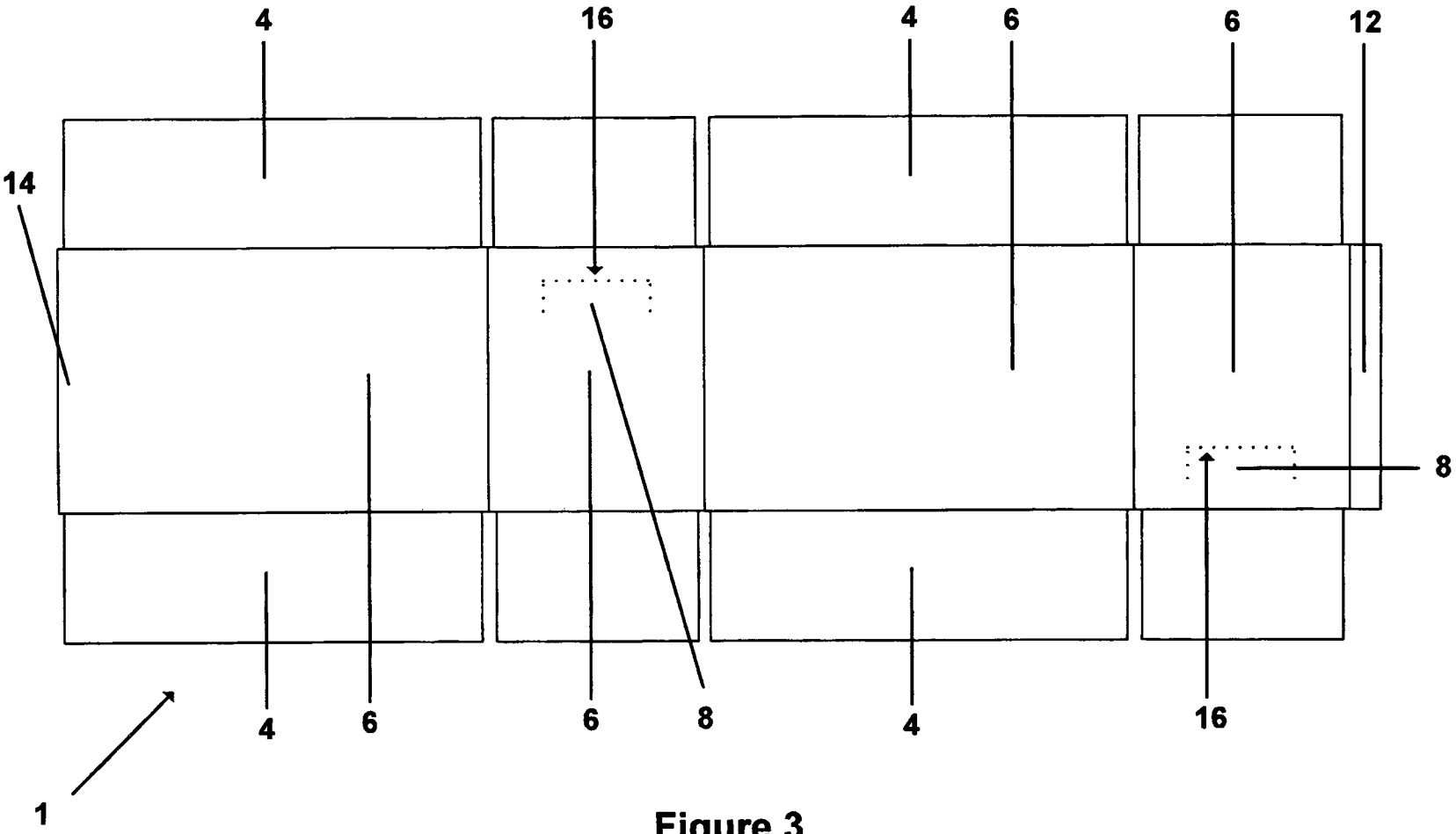
FIG. 3 is a plan view of a die cut of a third example box for packaging.
Figure 4:
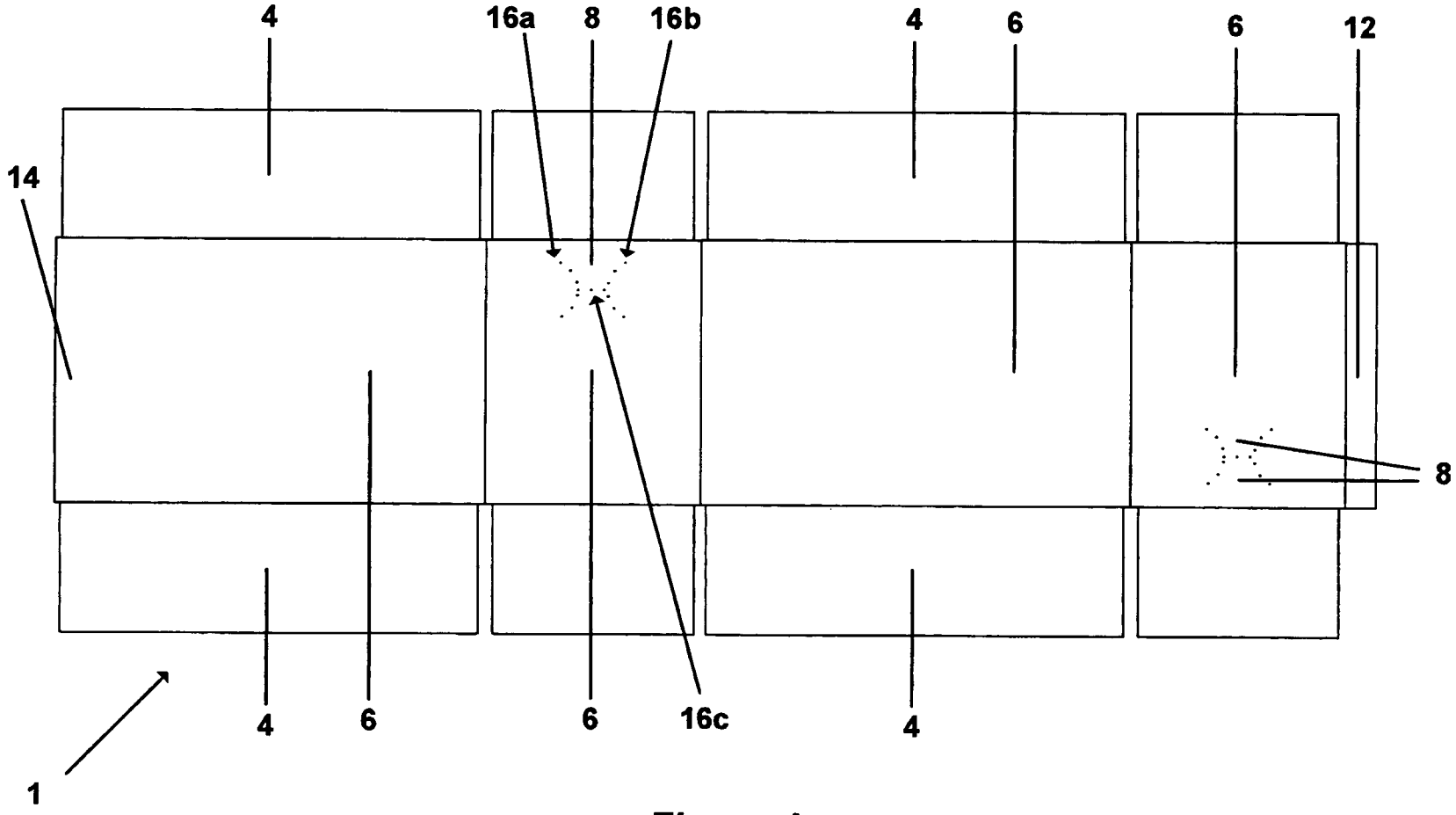
FIG. 4 is a plan view of a die cut of a fourth example box for packaging.

In another example, the perforated region (16) may be configured to divide along one or more substantially straight lines. FIG. 3 illustrates an example box (1) in which the perforated region (16) is configured to divide along three substantially straight lines.

In various examples, the hinge of the flap (8) may be situated between the perforated region (16) and the nearest edge of the wall panel (6), or the perforated region (16) may be situated between the hinge of the flap (8) and the nearest edge of the wall panel (6). The examples of FIGS. 2 and 3 illustrate both configurations.

Any perforated regions (16) are especially distanced from junctions of panels in the box (1), for example the junction between wall panel (6) and securing panel (4), so as to not compromise the structural integrity at these locations.

The wall panel (6) may also include two or more flaps (8), especially two flaps (8) that are configured to hingeably open such that when adhesive tape is applied to the securing panels (4) to secure the aperture (2) closed, the tape at least partially traverses the two or more flaps (8).

In one example, the wall panel (6) includes two flaps (8) that are configured to hingeably open, wherein the two flaps (8) share a perforated region (16) that is configured to divide when opening the two flaps (8). In such examples, the two flaps (8) are especially configured to hingeably open parallel to each other. FIGS. 1 and 4-11 illustrate examples of such configurations.

In these configurations, there may be more than one perforated region (16) where the at least two flaps (8) are located. For example, and as illustrated in FIGS. 1 and 4-11, there may be three perforated regions (16) that are configured to each divide when hingeably opening the two flaps (8). These examples all include two perforated regions (16*a*, 16*b*) that are configured to divide along a curved line, and one perforated region (16*c*) that is configured to divide along a substantially straight line. In the examples illustrated in FIGS. 1 and 5-11, the two perforated regions (16*a*, 16*b*) together define a convex shape. However, in the example illustrated in FIG. 4, the two perforated regions (16*a*, 16*b*) together define a concave shape. In other examples, there may be four or more perforated regions (16) where the at least two flaps (8) are located.

When there are two or more perforated regions (16), they may be configured to divide along any combination of curved, jagged, or substantially straight lines.

The box (1) also may be configured so that when a length of adhesive tape (10) is applied to the one or more securing panels (4) to secure the aperture (2) closed, only one end of the adhesive tape (10) at least partially traverses one or more of the flaps (8). FIGS. 1-4 and 6 illustrate such configurations. In another example, the box (1) may be configured so that when the adhesive tape (10) is applied to the one or more securing panels (4) to secure the aperture (2) closed, both ends of the adhesive tape (10) at least partially traverse one or more flaps (8), as illustrated in FIG. 5, allowing the tape to be removed from either end or both ends.

In another example, the box (1) includes two apertures (2) for packing or unpacking the box (1) and at least two securing panels (4) adapted to operatively secure each aperture (2) closed using adhesive tape (10), and wherein at least one wall panel (6) includes at least two flaps (8) that are configured to hingeably open to thereby assist in removing the adhesive tape (10) from the at least two securing panels (4). An example of this configuration is illustrated in FIG. 5.

In a further example, the box (1) includes two apertures (2) for packing or unpacking the box (1) and at least two securing panels (4) adapted to operatively secure each aperture (2) closed using adhesive tape (10), and wherein at least two wall panels (6) each include at least one flap (8) that is configured to hingeably open to thereby assist in removing the adhesive tape (10) from the at least two securing panels (4). Examples of this configuration are illustrated in FIGS. 1 to 6.

It will be appreciated that the above described arrangements allow the tape to be removed from the securing panels used to secure each of the apertures (2), which in turn allows the box to be returned to a flat pack arrangement, for example to allow a box to be easily stored or transported after use.

The presence of a flap (8) that is configured to hingeably open, especially when the flap (8) opens along a seam or fold in the wall panel (6) (such as when the box (1) is formed from cardboard), results in a number of advantages. In particular, such configurations may only require minimal changes to existing processes for the manufacture of boxes and may not require any additional materials to be incorporated into the existing design. This is especially the case when the box (1) is formed from cardboard. Furthermore, this allows the flap (8) to be realigned with the wall panel (6), and held in position, for example using tape, allowing the box to be reused.

The box (1) may also include a reinforcer (18) around the flap (8) that hingeably opens, thereby improving the structural integrity of the box (1). The reinforcer (18) may, for example, be in the form of a member positioned on a wall panel (6) so that it abuts one or more perforated regions (16), as shown in FIG. 2. In some examples, the reinforcer (18) may be solid or, for example, formed from folded cardboard. The reinforcer (18) may be formed integrally with the remainder of the box (1), or it may be affixed to the remainder of the box (1), for example with staples or adhesive. The reinforcer (18) may assist in maintaining the structural integrity of the box (1), or it may be used to reinforce the wall panel (6) such that when the flap (8) is hingeably opened a hand-hold for lifting the box (1) is provided.

The box (1) may also include adhesive tape (10), and the adhesive tape (10) is especially in contact with at least one securing panel (4) to secure at least one aperture (2) closed. In one example, the adhesive tape (10) traverses at least one of the flaps (8), as illustrated in FIGS. 8 to 11. In this example, the tape is positioned so that it remains affixed to the wall panel (6) when at least one of the flaps (8) is hingeably opened. This assists to separate the adhesive tape (10) from the wall panel (6), which then allows the user to grasp the separated adhesive tape (10) and pull the adhesive tape (10) from the box (1).

The type of adhesive tape (10) selected for use depends upon the material from which the box (1) is formed. The adhesive tape (10) must bind strongly, enough to secure the aperture (2) closed by contacting the at least one securing panel (4), whilst not binding so strongly that the adhesive tape cannot be removed without destroying the box (1). For example, if the box (1) is made from metal a stronger adhesive tape (10) may be used than if, for example, the box (1) is made from cardboard. In one example, the adhesive tape (10) is especially packaging tape or masking tape, although any other suitable tape may be used.

The box (1) may also be formed from various materials, such as metal, plastic or a cellulosic material such as wood, paper or cardboard. In one example, the box (1) is formed from cardboard.

Persons skilled in the art will appreciate that numerous variations and modifications will become apparent. All such variations and modifications which become apparent to persons skilled in the art, should be considered to fall within the spirit and scope that the invention broadly appearing before described.

The claims defining the invention are as follows:

1. A box for packaging, the box including:

(i) at least one aperture for packing or unpacking the box;

(ii) one or more securing panels adapted to operatively secure the aperture closed;

(iii) adhesive tape in contact with the one or more securing panels to secure the at least one aperture closed; and (iv) at least one wall panel, wherein the adhesive tape traverses entirely across two flaps of the wall panel with an end of the adhesive tape being attached to the wall panel beyond the two flaps, the two flaps being configured to hingeably open parallel to each other to thereby assist in removing the adhesive tape from the one or more securing panels, wherein the wall panel includes three perforated regions that are configured to each divide when hingeably opening the two flaps, and wherein the two flaps share one of the perforated regions.

2. The box according to claim 1, wherein at least one of the perforated regions is configured to divide along a curved line.

3. The box according to claim 1, wherein the two flaps are configured to hingeably open parallel to each other.

4. The box according to claim 3, wherein two of the perforated regions are configured to divide along a curved line and one of the perforated regions is configured to divide along a substantially straight line.

5. The box according to claim 1, wherein the at least one wall panel includes two wall panels which each includes two flaps that are configured to hingeably open.

6. The box according to claim 1, wherein the box includes two apertures for packing or unpacking the box, for each aperture, at least two securing panels adapted to operatively secure the aperture closed using a respective length of adhesive tape, and, for each aperture, two flaps that are configured to hingeably open to thereby assist in removing the respective length of adhesive tape from the respective at least two securing panels.

7. The box according to claim 1, wherein the box includes two apertures for packing or unpacking the box and, for each aperture, at least two securing panels adapted to operatively secure the aperture closed using a respective length of adhesive tape, and two wall panels, each wall panel including two flaps that are configured to hingeably open to thereby assist in removing the respective length of adhesive tape from the at least two securing panels for one of the apertures.

8. The box according to claim 1, wherein the box is formed from cellulosic material.

9. The box according to claim 8, wherein the box is formed from cardboard.

10. The box according to claim 1, wherein each flap includes a hinge.

11. The box according to claim 1, wherein the box is reusable.

12. The box according to claim 1, wherein each flap remains attached to the box after the adhesive tape is removed.

13. The box according to claim 7, wherein the two wall panels are provided on opposing ends of the box.

14. The box according to claim 1, wherein the two flaps are configured to hingeably open with the end of the tape remaining attached to the wall panel beyond the two flaps.

15. A method of removing adhesive tape from a box, the box including at least one aperture for packing or unpacking the box, one or more securing panels adapted to operatively secure the aperture closed and at least one wall panel, wherein the box includes adhesive tape which is in contact with the one or more securing panels to secure the at least one aperture closed, and wherein the adhesive tape traverses entirely across two flaps of the wall panel that are configured to hingeably open, wherein the wall panel includes three perforated regions that are configured to each divide when hingeably opening the two flaps, and wherein the two flaps share one of the perforated regions, and with an end of the adhesive tape being attached to the wall panel beyond the two flaps, wherein the method includes:

(i) hingeably opening the two flaps of the wall panel, thereby at least partially separating the adhesive tape from the wall panel;

(ii) grasping the at least partially separated adhesive tape; and (iii) pulling the grasped adhesive tape, thereby removing the adhesive tape from the box, while the one or more flaps remain hingeably attached to the box.

* * * * *